United States Patent [19]

Chenet

[11] 4,171,686

[45] Oct. 23, 1979

[54] CARBURATION DEVICES WITH IDLE ADJUSTMENT

[75] Inventor: Jacques Chenet, Sevres, France

[73] Assignee: Societe Industrielle de Brevets et d'Etudes S.I.B.E., France

[21] Appl. No.: 818,601

[22] Filed: Jul. 25, 1977

Related U.S. Application Data

[63] Continuation-in-part of Ser. No. 693,124, Jun. 4, 1976, Pat. No. 4,095,567.

[30] Foreign Application Priority Data

Jun. 26, 1975 [FR] France ..... 75 20163
Jul. 30, 1976 [FR] France ..... 76 23475

[51] Int. Cl.[2] ..... F02D 9/08

[52] U.S. Cl. ..... 123/103 R; 123/103 E; 261/DIG. 18

[58] Field of Search ..... 123/97 R, 97 B, 103 R, 123/103 C, 103 D, 103 E; 261/DIG. 18, DIG. 19, 39 B; 267/123; 251/54; 92/48

[56] References Cited

U.S. PATENT DOCUMENTS

| | | | |
|---|---|---|---|
| 3,577,962 | 5/1971 | Ojala | 123/103 R |
| 3,752,450 | 8/1973 | Charron | 123/DIG. 11 |
| 3,768,450 | 10/1973 | Harrison | 123/103 R |

FOREIGN PATENT DOCUMENTS

| | | | |
|---|---|---|---|
| 1944677 | 4/1970 | Fed. Rep. of Germany | 123/103 R |
| 1594991 | 7/1970 | France . | |
| 2188061 | 1/1974 | France | 123/103 R |
| 1055510 | 1/1967 | United Kingdom . | |

*Primary Examiner*—Charles J. Myhre
*Assistant Examiner*—Craig R. Feinberg
*Attorney, Agent, or Firm*—Stevens, Davis, Miller & Mosher

[57] ABSTRACT

A carburetor for an internal combustion engine comprises a fuel idling circuit opening into the intake pipe downstream of a driver-actuated main throttle. Idle regulation means comprise a first pneumatic element connected to that part of the intake pipe downstream of the main throttle and a second pneumatic element having a movable part connected to the main throttle means by a unidirectional connection such that the throttle means can be opened to an additional extent. The second pneumatic element is subjected to the vacuum in a chamber connected to said part of the intake pipe and also connected to atmosphere by a valve carried by the movable part of the second element and opened by the first pneumatic element moving with respect to the second pneumatic element when there is an increase in the degree of vacuum in the intake pipe. Additional means preventing the main throttle from closing beyond a partially open position and which are disabled after successful cranking may be provided.

7 Claims, 6 Drawing Figures

CARBURATION DEVICES WITH IDLE ADJUSTMENT

CROSS REFERENCES TO RELATED APPLICATIONS

This is a continuation-in-part of application Ser. No. 693,124 of June 4, 1976, now U.S. Pat. No. 4,095,567.

BACKGROUND AND SUMMARY OF THE INVENTION

The invention relates to carburation devices for internal combustion engines which comprise an idling circuit opening into that part of the intake pipe downstream of a driver-operable main throttle member for delivering thereto a primary mixture of fuel and air, at least when the throttle member is in its minimum opening position, for which an air passage is left between the throttle member and the wall of the intake pipe.

The engine idles when the main throttle member is in the aforementioned minimum opening position, i.e. when the accelerator pedal is released. When the main throttle member is progressively opened beyond the minimum opening position, there is an increase in the engine running speed as a result of the increase in the flow rate of air-fuel mixture supplied to the engine.

Usually, proper idling operation is obtained by suitably adjusting once for all the flow rates of air and fuel supplied to the engine under the aforementioned operating conditions. In modern motor vehicles, however, operating conditions are increasingly frequent in which the idling engine is suddenly loaded by the actuation of components of the vehicle (e.g. when the compressor of an air-conditioning system starts up, when an automatic gearbox operates, etc.). The load increase decreases the engine running speed and sometimes the engine stalls. To overcome that defect, means should be provided for maintaining the idling speed at a normal value when the engine is subjected to an additional load, e.g. by automatically opening the main throttle member (generally a butterfly valve) beyond its minimum opening position.

Various idling regulators have already been proposed for this purpose.

French patent specification No. 736,960 describes a device comprising a pneumatic element subjected to the underpressure which prevails downstream of the butterfly valve. That pneumatic element partly opens the butterfly valve when the underpressure falls below a threshold value, the partial opening being produced by a spring which opposes the underpressure force exerted on a diaphragm of the pneumatic element. When the spring expands, it moves an abutment secured to the butterfly valve.

This arrangement has a disadvantage: the opening of the butterfly valve is not controlled accurately since, under these circumstances, the spring acts against the considerable friction force in the linkage tending to maintain the accelerator linkage in the position for which the butterfly valve is in minimum opening condition.

French patent specification No. 1,594,991 discloses a pneumatic element comprising an aneroid capsule subjected to the underpressure which prevails downstream of a main throttle member and operatively connected to closure means adjusting the flow cross-sectional area of an additional air duct by-passing the throttle member; if the engine slows down when additionally loaded, the aneroid capsule retracts and the cross-sectional area of the additional air duct is increased. The additional air supplied to the intake manifold tends to increase the engine speed. If the stiffness of the capsule is appropriately selected, the amount of additional air admitted is sufficient to maintain the engine idling speed at its normal value. However, that arrangement, while it is suitable for adjusting the flow cross-sectional area of an additional air duct, is not adaptable for opening a main throttle member, which requires considerable mechanical force.

It is an object of the invention to provide a carburation device with means for regulating the idling speed by adjusting the degree of opening of the main throttle member. It is a more precise object to provide such a device in which a pneumatic element sensitive to the underpressure downstream of the main throttle member is not subjected to substantial mechanical stress, apart from that produced by the underpressure in the intake pipe.

It is another object of the invention to solve a problem associated with the starting devices of carburettors. Most starting devices comprise an auxiliary throttle member biased toward closure by a temperature responsive member sensitive to the temperature of the engine, when said temperature is lower than a predetermined limit value, and toward opening by the air flow which goes round it and by a pneumatic element subjected to the pressure prevailing in the intake pipe (which will also be designated as the inlet duct) downstream of the main throttle member.

In starting devices of this kind, the considerable depression or vacuum which prevails at the mouth of the main fuel supply system when the auxiliary throttle member (in general an excentrically mounted butterfly valve) is closed by the thermostatic member, allows a rich air-fuel mixture to be obtained during the operation of the starting motor. The richness must be decreased as soon as the engine starts up as to avoid choking and stalling the engine. For that, an opening of the butterfly valve is necessary; it is obtained responsive to the depression which builds up downstream of the main throttle member and acts on the pneumatic element moving the starting valve in the opening direction.

Most existing starting devices of this kind comprise auxiliary means, generally a fast idle cam, for preventing the main throttle member from closing again beyond a minimum degree of opening depending on the temperature of the engine. Such auxiliary means are necessary for transmitting to the main fuel delivery system, opening upstream of the main throttle member, a sufficient depression to obtain the proper enrichment.

Such auxiliary means present drawbacks; it is necessary, before starting up the engine, to "set" the fast idle cam by pressing the accelerator pedal, so that this cam may assume a position depending on the starting temperature, the cam providing an opening of the main throttle member, this opening being greater the lower the temperature. When the engine warms up, its speed increases. For the speed of the engine not to become excessive, it is necessary to free the fast idle cam by pressing on the accelerator, so that it can assume a position corresponding to the new temperature.

As long as the engine has not reached its normal working temperature, its running speed will in general be greater than the speed necessary for its normal operation, which entails a higher fuel consumption.

As indicated above, it is an ancillary object of the invention to provide a carburettor comprising an improved starting device.

In a carburation device according to a first aspect of the invention, the regulation means comprise a first pneumatic element connected to the part of the intake pipe which is located downstream of the main throttle member and a second pneumatic element having a movable part connected to the main throttle member by a unidirectional connection so that it can open the throttle member by an additional amount, the second pneumatic element being subjected to the pressure in a chamber connected to said part of the intake pipe and to atmosphere through a valve, said valve being carried by a movable part of the second element and being opened by the first pneumatic element responsive to movement of the latter with respect to the second pneumatic element upon an increase in the underpressure in the said part of the intake pipe.

According to another aspect of the invention, there is provided a carburettor in which the idling regulator means are operatively associated with subsidiary means preventing the main throttle member from closing beyond a predetermined partially open position, said subsidiary means being disabled in operation upon an increase of the depression which prevails downstream of the main throttle member beyond a predetermined threshold.

According to a particular embodiment of the invention, the subsidiary means comprise a stop cooperating with the main throttle member, movable between a rest position, in which it lets the main throttle member return to a position of minimum opening, and an active position, in which it prevents said main throttle member from closing beyond the predetermined partially open position, and means for maintaining said stop in its active position during cranking of the engine and until the depression is greater than the threshold.

The invention will be better understood from the following description of non-limitative embodiments of the invention. The description refers to the accompanying drawings.

SHORT DESCRIPTION OF THE DRAWINGS

Figure 1:
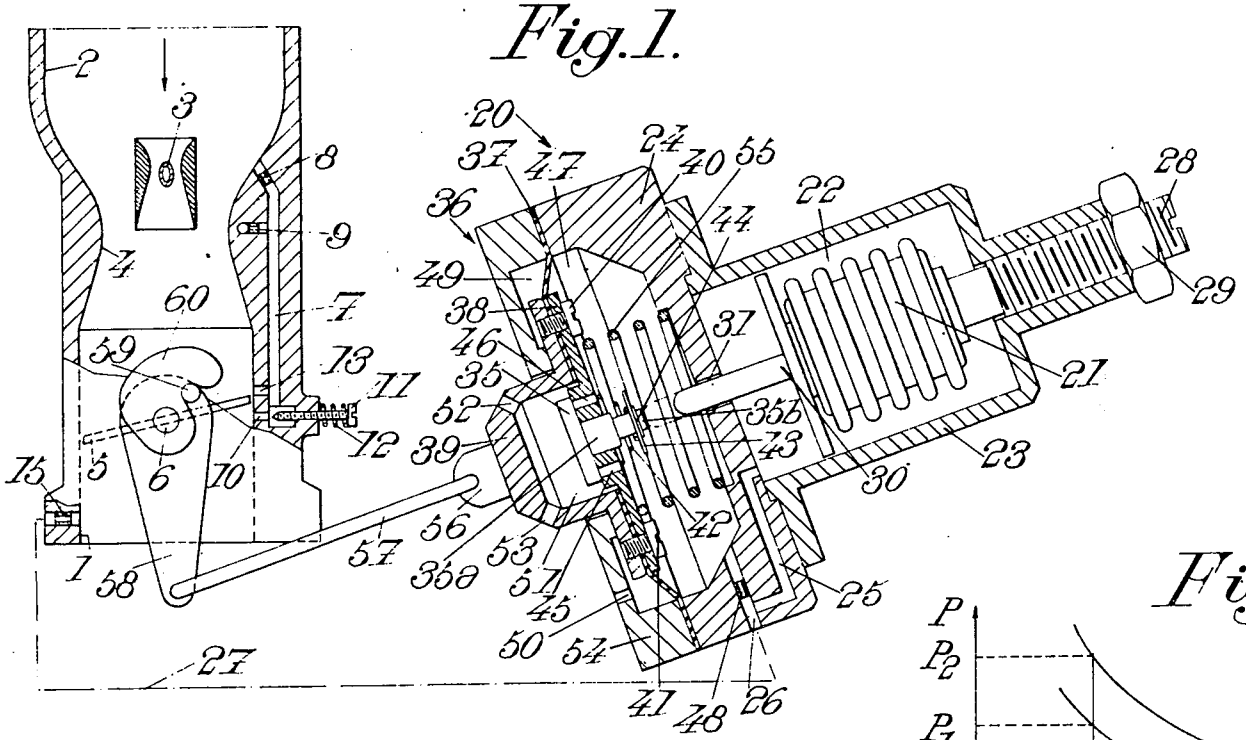
FIG. 1 is a cross-sectional view of the device, in the configuration when the engine is not running.
Figure 3:
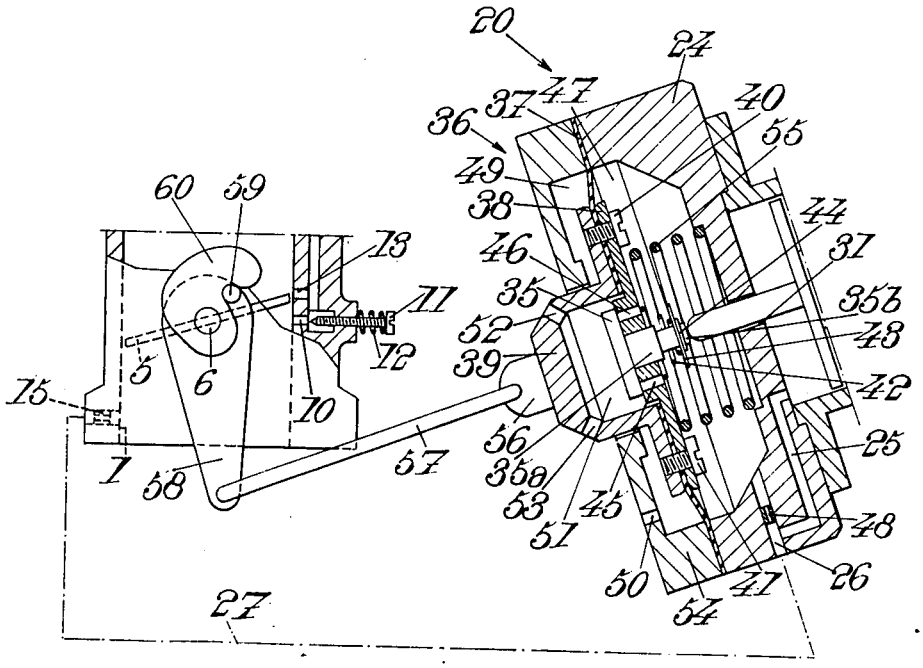

FIG. 3, similar to FIG. 1, shows a portion of the device, with the components in the positions corresponding to idling under load.

Figures 4, 5:
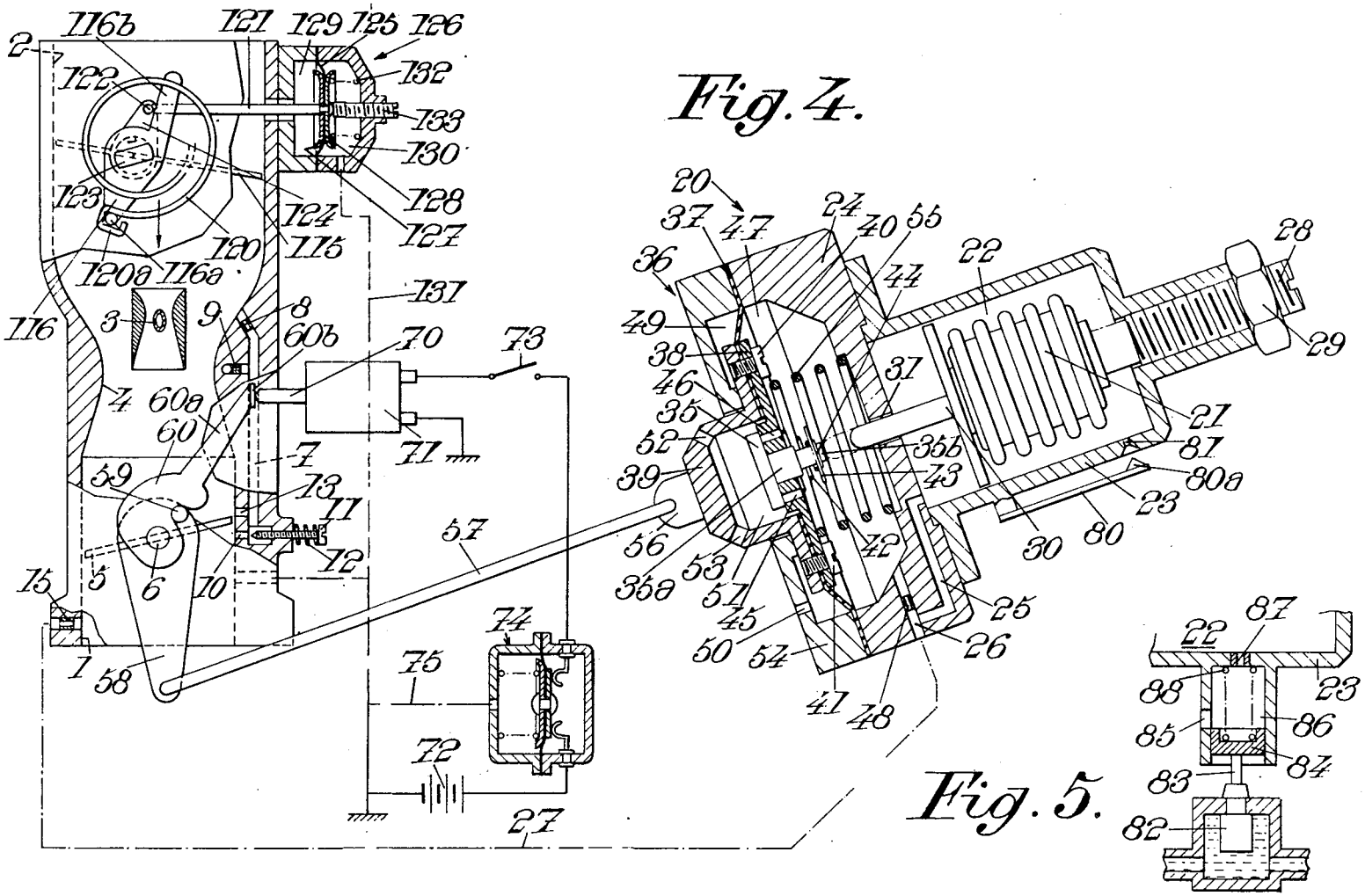
Figure 6:
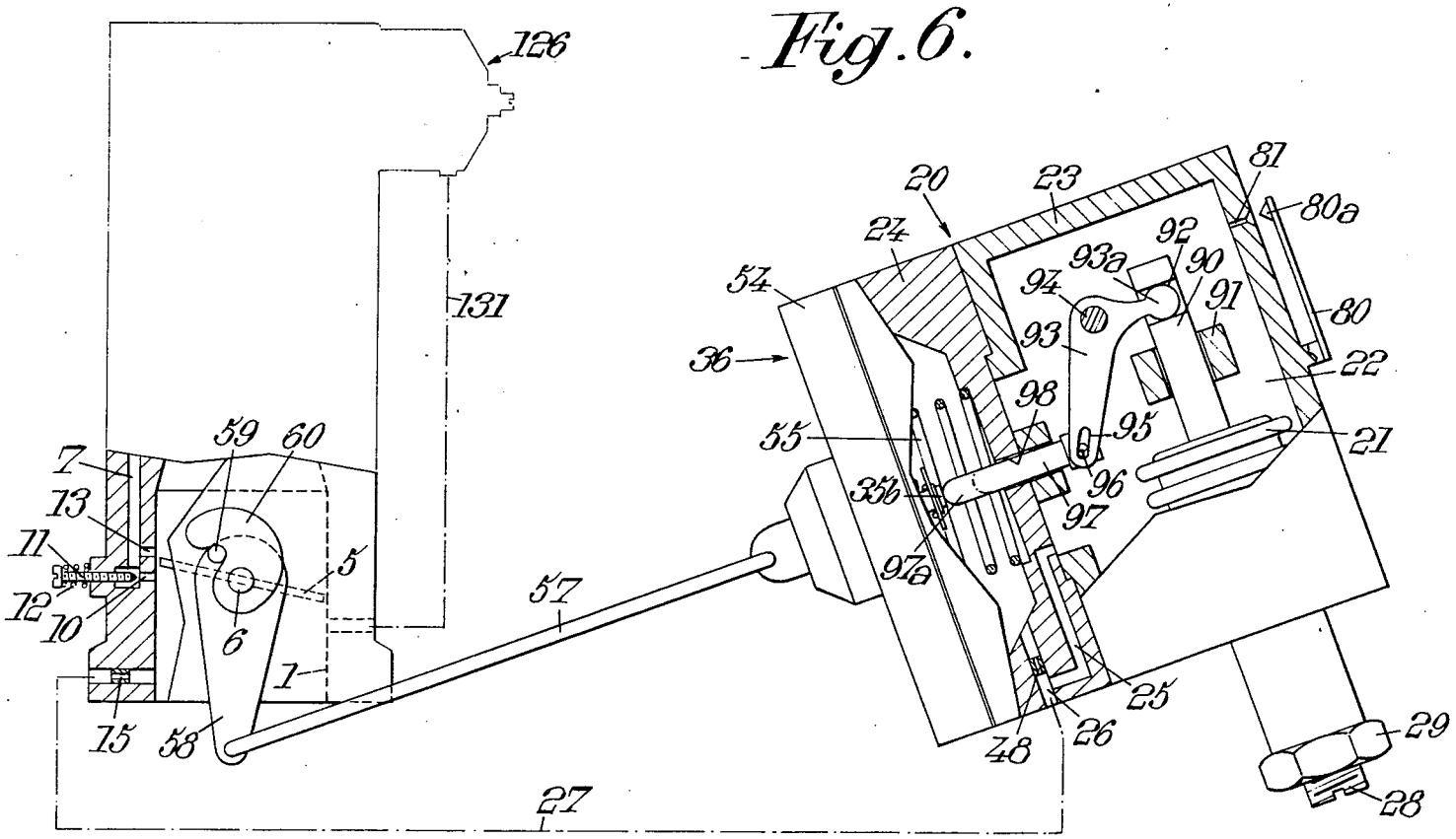

FIG. 4 is a schematic vertical cross-section of a carburettor according to another embodiment of the invention, the engine being cold and stopped and the ignition contact of the engine being open;

FIG. 5 shows a thermostatic element which is sensitive to the temperature of the engine and is used for adjusting the depression activating the idling regulator of the carburettor of FIG. 4; and FIG. 6 shows a modified embodiment in which the idling regulator is designed so as to maintain the main throttle member partly open at stop, the members being shown in the positions corresponding to an engine which is cold and stopped.

DETAILED DESCRIPTION OF PREFERRED EMBODIMENTS

Referring to FIG. 1, there is shown a carburettor comprising a normal-operation fuel supply circuit and an idling circuit, both opening into an intake pipe 1. The intake pipe 1 comprises the following components in the air-flow direction, as indicated by an arrow: an air intake 2, a main fuel jet system 3 which opens at a venturi 4 and a main throttle member 5 which, in the present case, is a butterfly valve carried by a rotatable shaft 6 extending through the wall of pipe 1 so that the butterfly valve can be actuated by an operator via a linkage (not shown).

Conventional stop means (not shown) prevents the throttle member from closing beyond a predetermined minimum opening position which may be variable with the temperature.

The idling circuit comprises a duct 7 whose upstream end is connected to the air intake 2 via a calibrated orifice 8 and is also connected to a constant-level float chamber (not shown) via a calibrated orifice 9. The downstream end of duct 7 is connected to an orifice 10 opening into pipe 1 downstream of butterfly valve 5. The flow cross-sectional area provided by orifice 10 can be adjusted by means of a screw 11 retained in adjusted position by a spring 12. Duct 7 may also be connected to pipe 1 by a transfer orifice 13 which is so disposed that the edge of butterfly valve 5 moves from downstream to upstream of it when the valve is partly opened from the minimum opening position shown in FIG. 1.

An idling regulator 20 comprises a casing made up of assembled parts and which is mounted on the carburettor body. A tubular housing 23 is secured to tone of the parts 24 of the casing and its internal compartment contains a flexible evacuated bellows of a type conventionally used as an aneroid capsule 21. A first pneumatic element consisting of the housing 23 and aneroid capsule 21 constitutes the sensing element of the idling regulator 20. Compartment 22 is connected to that part of the carburettor intake pipe 1 which is downstream of butterfly valve 5 by a duct 25 formed in the wall of part 24, a duct 26 and a connecting line 27 provided with a calibrated restriction 15. As a consequence, the underpressure or vacuum which prevails downstream of butterfly valve 5 is transmitted to compartment 22. The position of an end of capsule 21 in compartment 22 is adjustable by a threaded rod 28 secured to capsule 21 and screwed into a threaded part of body 23. A nut 29 screwed into a threaded rod 28 is adapted to secure it in position after adjustment. A rod 30 secured to the movable end of capsule 21, moves when variations occur in the underpressure in that part of pipe 1 downstream of the butterfly valve 5. Rod 30 is slidingly received in an aperture 31 of part 34 and projects beyond that part.

In the embodiment shown in FIG. 1, the free end of rod 30 acts as a movable abutment for a valve 35 mounted in the middle of a movable force applying part of a second pneumatic element 36. That movable part comprises a diaphragm 37 clamped between dish-like members 38 and 39 secured together by screws 40 and 41. It separates a first chamber 47, which is connected to that part of pipe 1 downstream of valve 5 by a calibrated restriction 48, duct 26 and connecting line 27, from a second chamber 49 maintained at atmospheric pressure by an orifice 50. Valve 35 has a first cylindrical portion 35*a* slidably mounted in member 38 and a second cylindrical portion 35*b* for abutment against the end of rod 30. A return spring 42 is compressed between member 38 and a washer 43 retained by a clip 44 engaging in a groove in the cylindrical member 35*b*. Spring 42 tends to urge valve 45 against member 38. When the valve is thus forcibly applied against member 38, it closes orifices 45 and 46 formed in member 38 and which connect chamber 47 and a compartment 51 in member 39. Compartment 51 is maintained at atmospheric pressure by apertures 52 and 53.

A part 54 and member 24 form the casing of pneumatic element 36. Parts 24 and 54 clamp the peripheral part of diaphragm 37. Member 54 serves as an abutment for the movable part of pneumatic element 36, when the pneumatic force exerted on diaphragm 37 by the underpressure prevailing in chamber 47 is less than the force of a return spring 55.

Finally, a lug 56 of member 39 is connected by a rod 57 to a lever 58 mounted for rotation about the shaft 6 of butterfly valve 5. A stud 59 of lever 58 has a unidirectional or one-way connection with a lever 60 secured to valve 5, for movement in the opening direction thereof.

Operation of the device is as follows:

Depending on the load on the engine, a predetermined idling speed "$N_o$" is achieved with the butterfly valve being opened to amounts $\alpha_0$, $\alpha_1$, $\alpha_2$, . . . (FIG. 2) which increases in proportion to the load on the engine. These degrees of opening correspond to pressures P0, P1, P2 in that part of pipe 1 downstream of the butterfly valve 5.

Each valve of pressure P is characteristic of the load on the engine running at speed $N_o$ and corresponds to a given state of the aneroid capsule 21 and consequently to a position of the free end of rod 30, since the pressure P is transmitted via connecting line 27, duct 26 and duct 25 to the chamber 22 containing the capsule.

When the engine idles at minimum load, i.e. at the load corresponding only to friction inside the engine, butterfly valve 5 is in the minimum opening position $\alpha_0$ and pressure P has the value P0. Under these conditions, no corrective action is required by regulator 20. Regulator 20 will be adjusted so that, under these conditions, the free end of rod 30 holds the movable part of pneumatic element 36 against component 54, as shown by dash-dot lines in FIG. 1.

Figure 2:
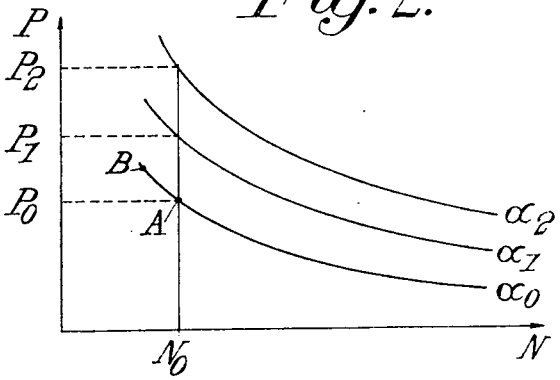
FIG. 2 is a diagram showing the relation between the engine running speed "N" and the pressure "P" in that part of the intake pipe downstream of the main throttle member, for various amounts of opening $\alpha_0$, $\alpha_1$ and $\alpha_2$ of the throttle member.

If the load on the engine suddenly increases from its minimum value, the engine tends to slow up and its operating point on the diagram in FIG. 2 tends to move from A to B, whereupon the regulator comes into action. When pressure P increases, capsule 21 contracts and moves the rod 30. Valve 35 closes. The pressure decreases in chamber 47 until it reaches the new value P transmitted by connecting line 27, duct 26 and calibrated orifice 48. The movable part of pneumatic element 36 moves against the action of spring 55 until the part 35*b* of valve 35 abuts the free end of rod 30, after which valve 35 tends to open and air enters chamber 47 through orifices 45 and 46, bringing the pressure in chamber 47 to a value such that the movable part of element 36 again tends to move away from rod 30 and valve 35 tends to close; the pressure then decreases in chamber 47 and valve 35 is again brought in contact with the end of rod 30, and so on. The movable part of element 36 rapidly reaches equilibrium if the calibrated orifices 15 and 48 are suitably selected. At equilibrium, valve 35 provides a leak cross-sectional area which depends on the flow cross-sectional area provided by orifices 15 and 48.

The resulting balance conditions correspond to wider opening of valve 5, to an extent depending on rod 57, lever 58, stud 59 and lever 60, as shown in FIG. 3.

If the stiffness of the aneroid capsule and the amplifying effect introduced by lever 58 have been suitably selected, the new degree of opening $\alpha$ of valve 5 maintains the engine idling speed at substantially the value $N_o$.

The force of spring 42 is selected at the lowest possible value (a few grams) compatible with satisfactory operation, so that the force exerted by valve 35 on rod 30 and consequently on the aneroid capsule is practically negligible and the capsule is not subjected to appreciable stresses.

A number of modified embodiments are possible. For instance, the first pneumatic element may be a pneumatic capsule comprising a deformable or movable element such as a diaphragm, one surface of which is subjected to the underpressure transmitted from the intake pipe through the calibrated orifice 15 and the connection 27.

Referring now to FIG. 4, there is shown a carburettor which comprises a body in which is formed an intake pipe or inlet duct 1. Duct 1 locates in succession, in the direction of air flow shown by an arrow: an air inlet 2; an auxiliary throttle member formed by a rotary valve 115; a main fuel jet system 3 belonging to a normal running supply circuit and issuing at the throat of a venturi 4; and a main throttle member 5 formed here by a butterfly valve carried by a shaft 6 which passes through the wall of duct 1 so that the throttle valve can be controlled by a linkage (not shown).

The carburettor also comprises an idling circuit which comprises a rich primary mixture supply channel 7. This channel 7 is connected upstream to air inlet 2 by a calibrated aperture 8 and to a float chamber (not shown) by a calibrated aperture 9. Channel 7 is connected downstream to a port 10 opening into duct 1 downstream of valve 5. The flow cross section offered by port 10 can be adjusted by means of a screw 11 retained by a spring 12. In the carburettor as illustrated, channel 7 communicates, furthermore, with duct 1 through a so-called "progression" or transfer port 13, located so as to pass from upstream to downstream of the edge of valve 5 as soon as the latter is partly open from the minimum opening position.

The starting system comprises, in the air intake of the carburettor and upstream of the fuel delivery system 3, starting valve 115 secured to a lever 116 fitted with a pin 116*a* cooperating with the free end 120*a* of a temperature sensitive member such as a bi-metal spiral 120 (partially shown in FIG. 1). This spiral is selected so that the free end 120*a* moves clockwise when the spiral heats up. The bi-metal spiral 120 is contained in a case (not shown) fixed to the body of the carburettor and its internal end is fixed to a boss in the case; spiral 120 is brought to a temperature representative of that of the engine by conventional heating means, formed for example by a circulation of air which has passed near to the exhaust manifold of the engine, or by circulation of the cooling water of the engine, or yet again by electric means. Lever 116 integral with the starting butterfly valve 115 has a one-way connection with a rod 121; in the embodiment illustrated, it comprises a flat surface formed on a lever 116 and cooperating with the end portion 122 of rod 121, bent at right angles. The end portion is maintained at a constant distance from axis 123 of the starting valve 115 by a lever 124 freely rotatable on shaft 123. The other end of rod 121 is connected to the diaphragm 125 of a pneumatic capsule 126. The central part of diaphragm 125 is clamped between two dished washers 127 and 128. The diaphragm divides the capsule 126 into two compartments 129 and 130. Compartment 129 is subjected to the pressure which prevails in air intake 2 of the inlet duct 1 and compartment 130 is connected by a connection 131 to the part of the inlet duct 1 situated downstream of throttle valve 5.

The carburettor comprises also means for regulating the idling and the degree of partial opening of the main throttle member at the time of cranking the engine.

The idling means of FIG. 4 are similar to those of FIG. 1. The corresponding parts are designated by the same reference numerals on both figures and will not be described again.

The subsidiary or accessory means for improved operation during starting are as follows:

Lever 60 comprises an extension 60*a* which finishes in a flat 60*b* cooperating with the mobile rod 70 of an electromagnet 71. When electromagnet 71 is de-energized, it lets the main throttle member return to the position of minimum opening shown in FIG. 4. When the electromagnet 71 is energized, rod 70 moves (towards the left in FIG. 4), pushes back the extension 60*a* and rotates the main throttle member 5, thus increasing the minimum opening.

The supply circuit for electromagnet 71 comprises a battery 72, a contact 73 which closes at the same time as the ignition contact of the engine and a pneumatically controlled electric contactor 74, subjected to the depression prevailing in duct 1 downstream of throttle valve 5, transmitted by a line 75, and to the opposing force of a spring. Contactor 74 remains closed as long as the depression in duct 1 does not reach a predetermined value.

Operation of the device is as follows:

When the engine is cold and stopped, the components are in the positions shown in FIG. 4; throttle valve 5 is free to come to its minimum opening position which can be defined by an adjustable stop or by the abutment of the moving part of element 36 on part 54.

As soon as the ignition contact of the engine is closed, contact 73 also closes. Electromagnet 71 is energized. Rod 70 moves, pushes back lever 60 and partially opens throttle valve 5. When the starting motor is operated, the depression which appears downstream of throttle valve 5 is transmitted by the partially open throttle valve 5 to the main fuel jet system 3 situated in the part of the inlet duct 1 defined by throttle valve 5 and butterfly valve 115; a rich air-fuel mixture is then drawn by the engine.

As soon as the engine becomes self-operating, the depression in duct 1 downstream of throttle valve 5 increases rapidly. On the one hand, it results in partial opening of butterfly valve 115 by the pneumatic element 126 to which this depression is transmitted by line 131. On the other hand, as soon as the depression exceeds a threshold determined by the stiffness of the spring in contact 74, the electromagnet 71 is de-energized by the opening of pneumatic contactor 74, subjected to the same depression by connection 75, and consequently, throttle valve 5 returns towards its minimum opening position. As a result, the mixture becomes leaner and stalling the engine because of an excess of richness is avoided.

Simultaneously, the idling regulator 20 is activated as in the embodiment of FIG. 1 and maintains the speed of the engine at a substantially constant value, by holding back the throttle valve if the engine tends to slow down and by letting it move more towards its minimum opening position if the engine tends to accelerate.

As the engine warms up, valve 115 opens against the ever smaller force of the bi-metal spiral 120, thus rendering the mixture supplied to the engine leaner. Opening of valve 115 is complete when the engine reaches its normal operating temperature. The fuel and air necessary for idling operation are then supplied respectively by the idling circuit and by the flow area left free between the wall of duct 1 and throttle valve 5.

Thus it can be seen that the engine operates properly from cranking up to its running at normal operating temperature.

For certain types of engine, it may be useful to introduce a correction of the action of the idling regulator 20 depending on the temperature of the engine; in fact, to obtain a determined rotational speed of the cold engine, it is necessary that the opening of the throttle valve be slightly greater than that necessary to obtain the same speed when the engine is hot, because of the greater internal friction when the engine runs cold.

This correction can be obtained by an air bleed towards compartment 22 containing the first pneumatic element, the variable flow cross section of the bleed being controlled by a thermostatic element sensitive to the temperature of the engine. This bleed attenuates the depression in compartment 22 and produces a greater opening of throttle valve 5.

In FIG. 4, the thermostatic element is a bi-metal strip 80 fixed on body 23 and whose free end 80*a* cooperates with a calibrated port of small diameter 81, formed in the wall of body 23, to modify the available flow cross section. When the engine is cold, the bi-metal strip 80 has the shape shown in FIG. 4, and aperture 81 is open. Air enters through aperture 81 and the pressure in compartment 22 is higher, decreasing the length of aneroid capsule 21 and moving (rightwards in the case of FIG. 4) rod 30 and the movable part of pneumatic element 36. Rod 57 drives lever 58 counterclockwise about shaft 6 and partially opens throttle valve 5.

Referring to FIG. 5, there is shown another embodiment of the thermostatic element which controls the passage section of the bleed attenuating the depression in compartment 22. A capsule 82 containing a heat expandable material and having a moving rod 83 is subjected to the temperature of the cooling water of the engine. Rod 83 drives a spool 84 which closes a variable portion of slit 85 putting into communication with the outside a chamber 86 connected to compartment 22 by a port 87 of small flow cross section. A spring 88 disposed in chamber 86 maintains the spool 84 in contact with the free end of moving rod 83.

When the engine heats up, the moving rod 83 extends and spool 84 progressively closes aperture 85, cutting off the air intake into compartment 22 through aperture 87 and, consequently, removing attenuation of the depression acting on aneroid capsule 21.

Referring to FIG. 6 (where the elements corresponding to those in FIG. 5 are shown by the same reference number) there is shown another embodiment of the invention, in which the idling regulator 20 is modified and directly imparts to the throttle valve the predetermined amount of partial opening necessary for starting up, without it being necessary to provide an accessory device comparable to electromagnet 71 of FIG. 5.

The regulator of FIG. 3 differs particularly from that of FIG. 5 in that the direction of action of the movable rod controlled by the aneroid capsule 21 and cooperating with cylindrical part 35*b* is reversed.

The aneroid capsule 21 is connected to a rod 90 sliding in a guide 91 fast with body 23. Rod 90 is formed with a notch 92 cooperating with the rounded end 93*a* of a cranked lever 93 pivoting about a shaft 94 integral with body 23. The other end of lever 93 is provided with a slot 95 inside which can move a pin 96 carried by a movable rod 97 passing through part 24 through a hole 98 and whose free end 97*a* cooperates with the cylindrical part 35*b* of the movable part of the pneumatic element 36.

Idling regulator 20 is connected to throttle valve 5 of the carburettor in the following way; rod 57 of the regulator 20 is coupled to a lever 58 mounted loose on shaft 6 of throttle valve 5. A pin 59 of lever 58 has a one-way connection with lever 60 fast with throttle valve 5, in the direction of opening of the throttle valve.

This embodiment operates as follows.

When the engine is cold and at rest, the elements are in the positions shown in FIG. 6: spring 55 of pneumatic element 36 maintains the moving part of element 36 in abutment against part 54 and throttle valve 5 partially opened by a determined value, by means of rod 57, lever 58, pin 59 and lever 60 fast with throttle valve 5.

Spring 55 is selected to exert a force sufficient to maintain throttle valve 5 partially open against the closing force of the accelerator linkage.

Therefore, when the starter is operated, the fuel supply system 3 delivers a rate of fuel sufficient for a rich air-fuel mixture to be provided to the engine.

As soon as the engine is started up, the substantial depression which appears downstream of throttle valve 5 is transmitted to the idling regulator 20 by aperture 15 and line 27; the opening of throttle valve 5 is then automatically adjusted by the regulator 20, in a manner similar to that of the regulator shown in FIG. 4.

The device of FIG. 6 comprises also a temperature responsive element 80, similar to that of FIG. 4. When the engine is cold, element 80 maintains aperture 81 open. Rod 87 assumes a position which is, in the figure, more to the left than that which it would assume in the absence of aperture 81. The same goes for the moving part of pneumatic element 36. Rod 57 rotates lever 58 clockwise about shaft 6 and partially opens throttle valve 5.

Numerous other embodiments could obviously be made to the invention. For example, in the idling regulator, the aneroid capsule can be replaced by an ordinary pneumatic capsule, one of the chambers of this element being then subjected to the atmospheric pressure and the other to the depression prevailing in the inlet duct downstream of the throttle valve.

I claim:

1. A carburation device for internal combustion engine comprising:

an intake pipe, an operator operable main throttle member in said intake pipe, stop means for preventing said throttle member from closing beyond a predetermined minimum opening position by which an air flow cross-section is defined by the throttle member in the intake pipe, an idling circuit constructed to receive fuel and air and terminating into a part of said intake pipe downstream of said throttle member, and idling regulator means which includes:

a first pneumatic element having movable wall means, means for connecting said element to said part of the intake pipe so that the position of the movable wall means is determined by the degree of underpressure in said part of the intake pipe, a second pneumatic element having force applying wall means drivably connected to said main throttle member via a one-way connection to move said throttle member in the direction of opening, and valve means carried by the force applying drive wall means arranged to be engaged and actuated by the wall means of said first pneumatic element upon movement of said wall means of said first pneumatic element toward said force applying wall means responsive to increase of said degree of underpressure, said valve means upon actuation thereof modifying the underpressure applied to said force applying wall means whereby the latter is moved in the direction corresponding to a decrease in the minimum degree of opening of said throttle, and further comprising, operatively associated with the idling regulator means, subsidiary means for preventing the main throttle member from closing beyond a predetermined partially open position, said subsidiary means being disabled in operation upon an increase of the underpressure which prevails downstream of the main throttle member beyond a predetermined threshold.

2. A carburation device according to claim 1, wherein the second pneumatic element is provided with resilient return means which return at rest the moving part of said second pneumatic element to a position preventing the main throttle member from closing beyond said determined partially open position, said resilient means exerting a force which opposes the action of the underpressure which prevails in the chamber, connected to said part of the inlet duct and to the atmosphere by a valve carried by said moving part and moved to the open position by the relative movement of the first pneumatic element and the second pneumatic element, the valve being normally closed and opening by abutment against a member controlled by the first pneumatic element after said moving part has travelled from its rest position over a distance which is longer the higher the depression to which the first pneumatic element is subjected.

3. A carburation device according to claim 1, having temperature responsive means arranged for attenuating the underpressure which is exerted on the first pneumatic element, in relation to that which prevails in the part of the inlet duct located downstream of the main throttle member, as long as the engine has not reached the predetermined temperature.

4. A carburation device according to claim 1, including a thermostatic means comprising a strip or a capsule provided with a member for closing off a hole provided in the wall of a chamber occupied by the first pneumatic element, said member closing the hole when the temperature of the engine increases.

5. A carburation device according to claim 1, wherein the first pneumatic element is an aneroid capsule placed in a chamber connected to the part of the inlet duct located downstream of the main throttle member.

6. A carburation device according to claim 1, wherein the subsidiary means comprise a stop cooperating with the main throttle member, movable between a rest position, in which it lets the main throttle member return to a position of minimum opening, and an active position, in which it prevents said main throttle member from closing beyond the predetermined partially open position, and means for maintaining said stop in its active position during cranking of the engine and until the underpressure is greater than the threshold.

7. A carburation device according to claim 6, wherein the stop is formed by a movable element of an electromagnet whose electric energizing circuit comprises, in series relation, a current source; a switch which closes at the same time as an ignition switch of the engine, and a pneumatically controlled contactor connected to the part of the inlet duct located downstream of the main throttle member and arranged to open when the underpressure therein exceeds the threshold.

* * * * *